US008745650B1

(12) United States Patent
Bachman

(10) Patent No.: US 8,745,650 B1
(45) Date of Patent: Jun. 3, 2014

(54) CONTENT SEGMENT SELECTION BASED ON TIME-SHIFTED CONTENT VIEWING

(71) Applicant: Michael Bachman, Sunnyvale, CA (US)

(72) Inventor: Michael Bachman, Sunnyvale, CA (US)

(73) Assignee: Google Inc., Mountain View, CA (US)

( * ) Notice: Subject to any disclaimer, the term of this patent is extended or adjusted under 35 U.S.C. 154(b) by 0 days.

(21) Appl. No.: 13/648,745

(22) Filed: Oct. 10, 2012

(51) Int. Cl.
*H04H 60/32* (2008.01)

(52) U.S. Cl.
USPC ..... 725/14; 725/9; 725/32; 725/34; 725/93; 725/110; 725/112; 725/116; 725/146

(58) Field of Classification Search
USPC ..... 725/32, 34, 93, 110, 112, 116, 146, 9, 725/14
See application file for complete search history.

(56) References Cited

U.S. PATENT DOCUMENTS

| | | | | |
|---|---|---|---|---|
| 8,145,524 | B2 | 3/2012 | Cansler et al. | |
| 2002/0178447 | A1 | 11/2002 | Plotnick et al. | |
| 2007/0074258 | A1 | 3/2007 | Wood et al. | |
| 2008/0109298 | A1 * | 5/2008 | Barton | 705/10 |
| 2008/0133475 | A1 | 6/2008 | Fischer | |
| 2009/0216616 | A1 * | 8/2009 | Wang et al. | 705/10 |
| 2010/0162333 | A1 * | 6/2010 | Sylvain | 725/109 |
| 2011/0145847 | A1 * | 6/2011 | Barve et al. | 725/9 |
| 2013/0139192 | A1 * | 5/2013 | Fontan et al. | 725/8 |

* cited by examiner

*Primary Examiner* — Mulugeta Mengesha
(74) *Attorney, Agent, or Firm* — Dickinson Wright PLLC

(57) ABSTRACT

A method, executed by a processor, for selecting content segments to serve to a viewer based on time-delayed television content viewed by the viewer includes receiving by the processor, a notification for a visit by the viewer to the resource; accessing by the processor, a time-delayed content viewing history; and in response to the notification, identifying by the processor, based on the history, one or more content segments to serve at the resource.

16 Claims, 8 Drawing Sheets

400

500

600

CONTENT SEGMENT SELECTION BASED ON TIME-SHIFTED CONTENT VIEWING

BACKGROUND

Digital video recorders allow viewers to record television programming and watch the programming at a later time. Such time-shifted, or time-delayed, program viewing is convenient for many viewers. Since the programming is recorded, the digital video recorders also allow the viewer to skip program segments and advertisements.

DESCRIPTION OF THE DRAWINGS

The detailed description refers to the following figures in which like numerals refer to like items, and in which.

DETAILED DESCRIPTION

Figure 1:
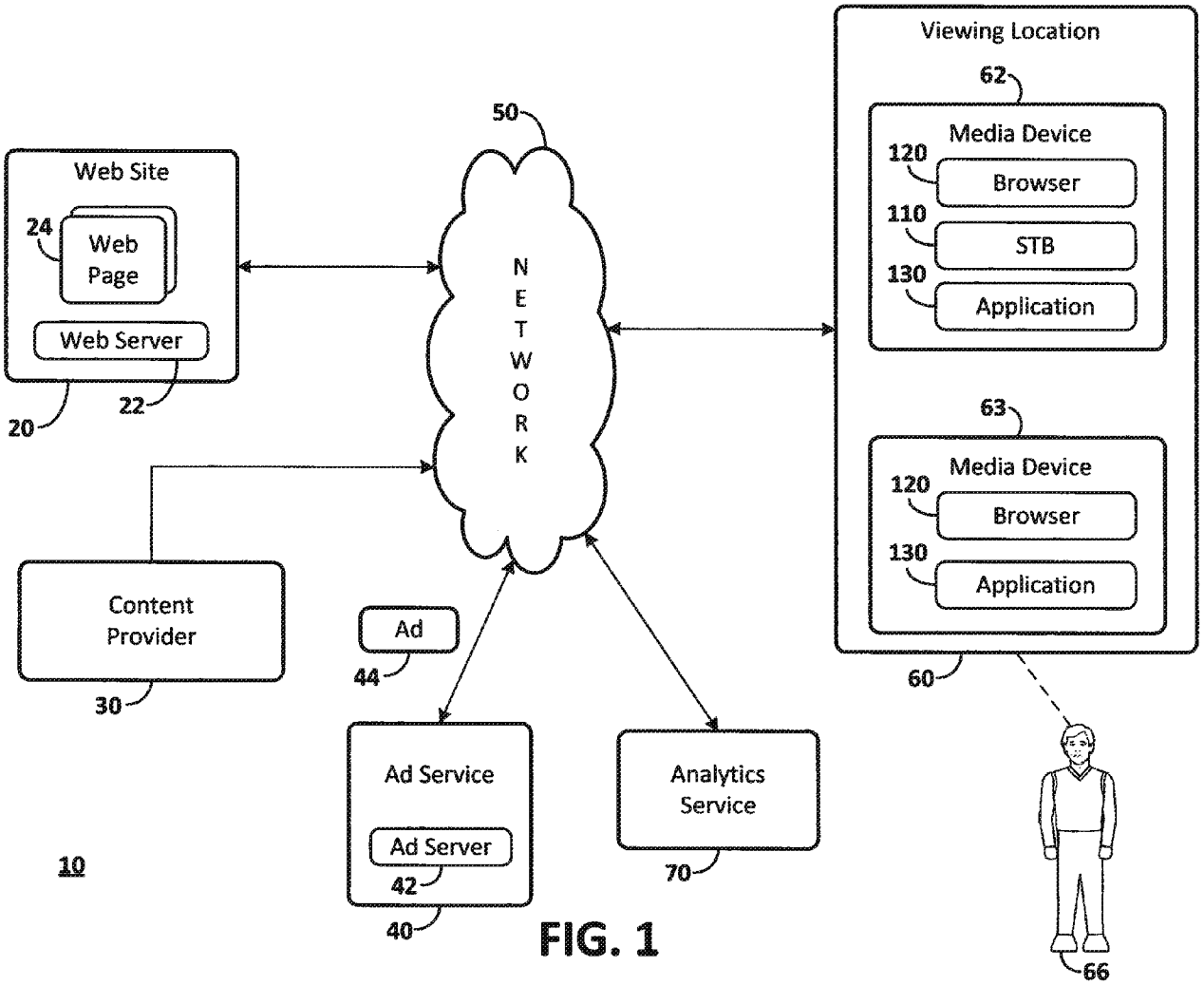
FIG. 1 illustrates an example environment in which content segment selection may be based on time-shifted content viewing.

Digital video recorders allow viewers to record television programming and watch the programming at a later time. Such time-shifted, or time-delayed, content viewing is convenient for many viewers. Since the programming is recorded, the digital video recorders also allow the viewer to skip content segments and content segments such as advertisements. Time-shifted content viewing makes collection of content viewed data difficult and unreliable using current systems and methods.

To overcome deficiencies with current collection systems and methods, disclosed herein are systems and methods that may be used for content segment selection based on time-shifted content viewing. The systems and methods apply, in an embodiment, to collection of data from broadcast television programming. The television programming may be broadcast over-the-air, by satellite, or by cable. The broadcast television programming is received, for example, at a viewer's set top box (STB) or similar device. The STB may include an integrated content recording and playback device. The content recording and playback device allows the viewer to selectively record, and later watch, live television programming.

The systems and methods also may apply to the collection of data from streamed television programming (i.e., Internet-supplied television programming).

The herein disclosed systems may be incorporated into the STB or similar device. Alternately, the herein disclosed systems may be standalone systems. A standalone system may connect to and interact with the STB. The systems and methods detect the replay of live content, and determine if that content is viewed at normal speed of or at high speed (e.g., 2 times or 4 times normal speed); that is, the content segment is "skipped." The systems further may use content recognition mechanisms to identify the viewed content segments or advertisements.

In an embodiment, the systems serve specific content segments or advertisements to specific viewers based on a sufficient history of time-shifted content segment viewing. For example, the systems may accumulate at least seven days of viewing history before ascertaining a content segment viewing preference for a viewer.

In an embodiment, the systems serve content segments such as advertisements to the viewer during subsequent viewing of television programming over the Internet. The systems may use a unique identification of a media device used by the viewer to view the Internet-based television programming.

The processes executed by the herein disclosed systems may involve use of information that in some respect identifies a device the viewer uses to access the television programming. For example, when a viewer uses an Internet browser to access a Web site, a Web server may create a random identification (ID) that identifies the browser and may cause the random ID to be stored on the viewer's device.

In situations in which the systems disclosed herein collect personal information about viewers, or may make use of personal information, the viewers may be provided with an opportunity to control whether programs or features collect viewer information (e.g., information about a viewer's social network, social actions or activities, profession, a viewer's preferences, or a viewer's current location), or to control whether and/or how to receive advertisements from an ad server that may be more relevant or of interest to the viewer. In addition, certain data may be treated in one or more ways before it is stored or used, so that personally identifiable information is removed. For example, a viewer's identity may be treated so that no personally identifiable information can be determined for the viewer, or a viewer's geographic location may be generalized where location information is obtained (such as to a city, ZIP code, or state level), so that a particular location of a viewer cannot be determined. Thus, the viewer may have control over how information is collected about the viewer and used by a content server.

In an embodiment, a viewer operates a media device, which may be an Internet-connected television, a television with a set top box that includes Internet connection features (e.g., a browser), a lap top computer, or other media devices capable of connecting to the Internet. The media device may receive broadcast television programs and streamed television programs. The media device may incorporate a digital video recorder. The viewer may operate the digital video recorder to record, and later watch, broadcast or streamed television programs. The media device, with the consent of the viewer, may provide information related to the time-shifted viewing of the recorded television programs to an analytics service that establishes a television content viewing history for the viewer. The information may identify content segments, such as advertisements and television programs that the viewer watches at normal speed (i.e., without using a fast forward or skip feature). In an embodiment, the content segment identification may be based on metadata included with the display of the content segment. For example, each advertisement or television program may include within the broadcast or streamed content, a unique identification. Other metadata may identify the content of the streamed content. For example, the metadata may identify an advertisement as pertaining to a specific automobile manufacturer, and more particularly to a specific automobile model. However, with some content segments, an identification may not be available in or discernible from the broadcast or streamed content. In this situation, a back end system that, for example, records audio or video of some or all broadcast or streamed live television programs may be used to establish the identity of the content segments. The back end system compares a content segment ID as recorded by the back end system to a content segment ID recorded by the media device. When a match is found between the two content segment IDs, the back end system may determine the content of the content segment by analysis of the recorded audio or video. The back end system then may establish a content segment viewing history for individual viewers.

Subsequent to the establishment of a content segment viewing history, a viewer may access a streaming television Web site, for example, and select a television program to view. The Web site visit may result in the Web site sending an ad request to an advertisement service, and the advertisement service returning an advertisement that is served to the viewer by display on the Web site. The advertisement service may select the advertisement to serve based on the accumulated content segment viewing history for the viewer. As noted above, the content segment viewing history is established from information collected during time-shifted viewing of broadcast or streamed television programs, and associated advertisements, that actually are viewed (i.e., not skipped or fast-forwarded) by the viewer. Thus, the herein disclosed systems and methods allow selection of advertisements to serve to a viewer based on the viewer's time-shifted television content viewing.

FIG. 1 illustrates and example environment in which content segments, are served to a viewer of Internet-based television programming based on a history of viewing time-shifted television programming as accumulated through operation of a digital video recorder or similar device. In an embodiment, the content segments are advertisements.

In FIG. 1, environment 10 includes Web site 20, content provider 30, advertisement service 40, viewing location 60, and analytics service 70, all of which communicate over communications network 50.

The Web site 20 includes Web server 22. The Web server 22 streams online television programming to viewing location 60. The online television programming may be viewed when a viewer access a specific Web page 24.

The Web server 22 may detect when a viewer is using a specific media device to access television programming served at the Web page 24. For example, and as discussed in more detail below, the Web server 22 may determine that a specific media device is connected to and receiving content from the Web page 24 based on a unique identification of the media device, such as its Internet Protocol (IP) address, for example. The Web server 22 may notify the advertisement service 40 when a specific media device access is detected.

The content provider 30 provides television programming to the Web site 20 for streaming to the viewing location 60.

In an embodiment, the functions and components of the Web site 20 and content provider 30 may be combined into a single entity.

The advertisement service 40 operates ad server 42 to provide advertisements 44 that may be served at a Web page 24 to be viewed by a viewer at the viewing location 60. The advertisement service 40 may represent a single company or entity, a group of related companies, or a group of unrelated companies (e.g., the advertisement service 40 may operate as an ad broker). The advertisements 44 may be static advertisements or video advertisements. The advertisements 44 may include audio features. The advertisements 44 may be in a rich media format. The advertisement service 40 may provide an advertising campaign that includes both static and video advertising. The static advertisements and video advertisements may complement each other; that is, the static advertisements and the video advertisements may be related to the same product or service. The advertisements 44 may be served at the same time that a television program is streamed to a viewer. The advertisements 44 may be shown as a video overlay of a streamed television program, before and/or after display of the program, and during pauses in the program. The advertisements 44 may be served in specific locations of the Web page 24 while the program is displayed in a different location of the Web page 24. The advertisements 44 may change during display of the program.

The advertisements 44 may include links to other Web pages and other Web sites. For example, an advertisement for a car may include a link to a car manufacturer's Web site. A viewer watching a television program may "click" on the advertisement and be redirected to the car manufacturer's Web site.

The advertisement service 40 may receive a notification from the Web serve 22 when a specific media device accesses the Web page 24 and begins receiving streamed television programming. The advertisement service 40 may use this notification as a trigger to serve advertisements to the specific Web page 24.

The network 50 may be any communications network that allows the transmission of signals, media, messages, voice, and data among the entities shown in FIG. 1, including radio, linear broadcast (over-the-air, cable, and satellite) television, on-demand channels, over-the-top media, including streaming video, movies, video clips, and games, and text, email, and still images, and transmission of signals, media, messages, voice, and data from a media device to another media device, computer, or server. The network 50 includes the Internet, cellular systems, and other current and future mechanisms for transmission of these and other media. The network 50 may be both wired and wireless.

The viewing location 60 may be the residence of an individual viewer, such as viewer 66, who operates media devices 62 and 63 to access resources such as the Web pages 24 at the Web site 20. The media devices 62 and 63 may be fixed or mobile. For example, media device 62 may be an Internet connected "smart" television (ITV); a "basic" or "smart" television connected to a set top box (STB) 110 or other Internet-enabled device; a Blu-Ray™ player; and a game box; for example. Media device 63 may be a tablet, a smart phone, a laptop computer, or a desk top computer, for example. The media devices 62 and 63 may include browsers, such as browser 120. The browser 120 may be a software application for retrieving, presenting, and traversing resources such as at the Web site 20. A resource may be identified by a Uniform Resource Locator (URL) and may be a Web page, image, video, or other content. The URL may allow the browser 120 to connect to the Web site 20. Hyperlinks present in resources enable the viewer 66 to navigate the browser 120 to related resources. The viewer 66 may operate the browser 120 to search for Web sites related to specific topics or to search for a specific Web site by URL. The media devices 62 and 63 also may include application 130. The viewer 66 may cause the media devices 62 or 63 to execute an application 130, such as a mobile banking application, to access online banking services. The application 130 may involve use of the browser 120 or other means, including cellular means, to connect to the online banking services.

Once connected to the Web site 20, the media devices 62 and 63 may allow viewing of content such as streaming television programs, video programs, and static images, some of which may be generated by the program provider 30 and displayed on the Web pages 24 at the Web site 20. The streaming television programs, video programs, and static images may include slots or spaces into which content segments such as advertisements may be placed. When such a streaming television program, video program, or static image is viewed on the media devices 62 or 63, the Web server 22 may send an advertisement (ad) request, which is received at the advertisement service 40, and which may be answered with an advertisement 44.

When visiting the Web site 20, the viewer 66 may register with and log on to the Web site 20 by providing a viewer-created identification (hereafter, a user ID) and a password and/or pass code, for example. Alternately, the viewer 66 may access the Web site 20 without registering and without logging on. Whether or not logged on, the viewer 66 may take actions that may be recorded as viewer actions at the Web site 20 such as selecting a television program for online viewing, for example. These and other viewer actions then may be sent from the Web server 22 to the advertisement service 40 and/or the analytics service 70.

In an embodiment, the viewer 66 may register both media devices 62 and 63 with the Web server 22 such that both media devices 62 and 63 are linked. In this embodiment, one media device may display a streaming television program and the other media device may display an advertisement based on the viewer's accumulated advertisement viewing history.

When using an application 130, the viewer 66 may make various selections that also may be sent by the Web server 22 to the advertisement service 40. For example, the viewer 66 may select a pop-up or overlay advertisement presented during execution of the application 130. The selection may be recorded and sent to the analytics service 70 as an impression. Moreover, when operating the application 130, the viewer 66 may be served with an advertisement based on the viewer's accumulated advertisement viewing history.

The browser 120 may include computer code to store a file and record viewer actions. The browser 120 may store information related to Web site visits, including the URL of the Web site, date and time of visit, length of visit (or start and stop time of visit), and actions taken by the viewer 66 during the visit. The browser 120 may store information that unambiguously identifies the viewer's media device. However, the browser 120 may do so without storing any personally-identifiable information regarding the viewer 66. Similarly, the application 130 may store media device identification information, Internet address information, and other data and information related to use of the application 130. The application 130 and browser 120 may provide this information to the analytics service 70.

The analytics service 70 receives, with the consent of the viewer 66, information related to the advertisement viewing of the viewer 66. The information may include time-shifted viewing information. The information may be collected by the STB 110 or other components integrated into or connected to the media device. See for example, components 61' in FIG. 2B. The information may be provided to the analytics service 70 by the browser 120. The information may include data that shows which content segments were viewed at normal speed, and which content segments were "skipped" (e.g., where the viewer 66 operated a skip button or a fast forward button). The viewing history may be provided to the advertisement service 40 and/or the analytics service 70.

The analytics service 70 may establish an advertisement viewing history for the viewer 66. The service 70 may store the history and use the history to identify or suggest specific advertisements or advertisement types to serve at Web sites being visited by the viewer 66. For example, the service 70 may determine that in terms of viewing time-shifted television programs, the viewer 66 routinely plays advertisements for automobiles at normal speed but plays all other advertisements at fast speed. The service 70 may use algorithms to analyze this viewing pattern and to determine that the viewer 66 has an interest in automobiles. When the viewer 66 subsequently visits a Web site, the service 70 may indicate to the advertisement service 40 that the Web site being visited by the viewer 66 should be served with an automobile advertisement.

Figure 2A:
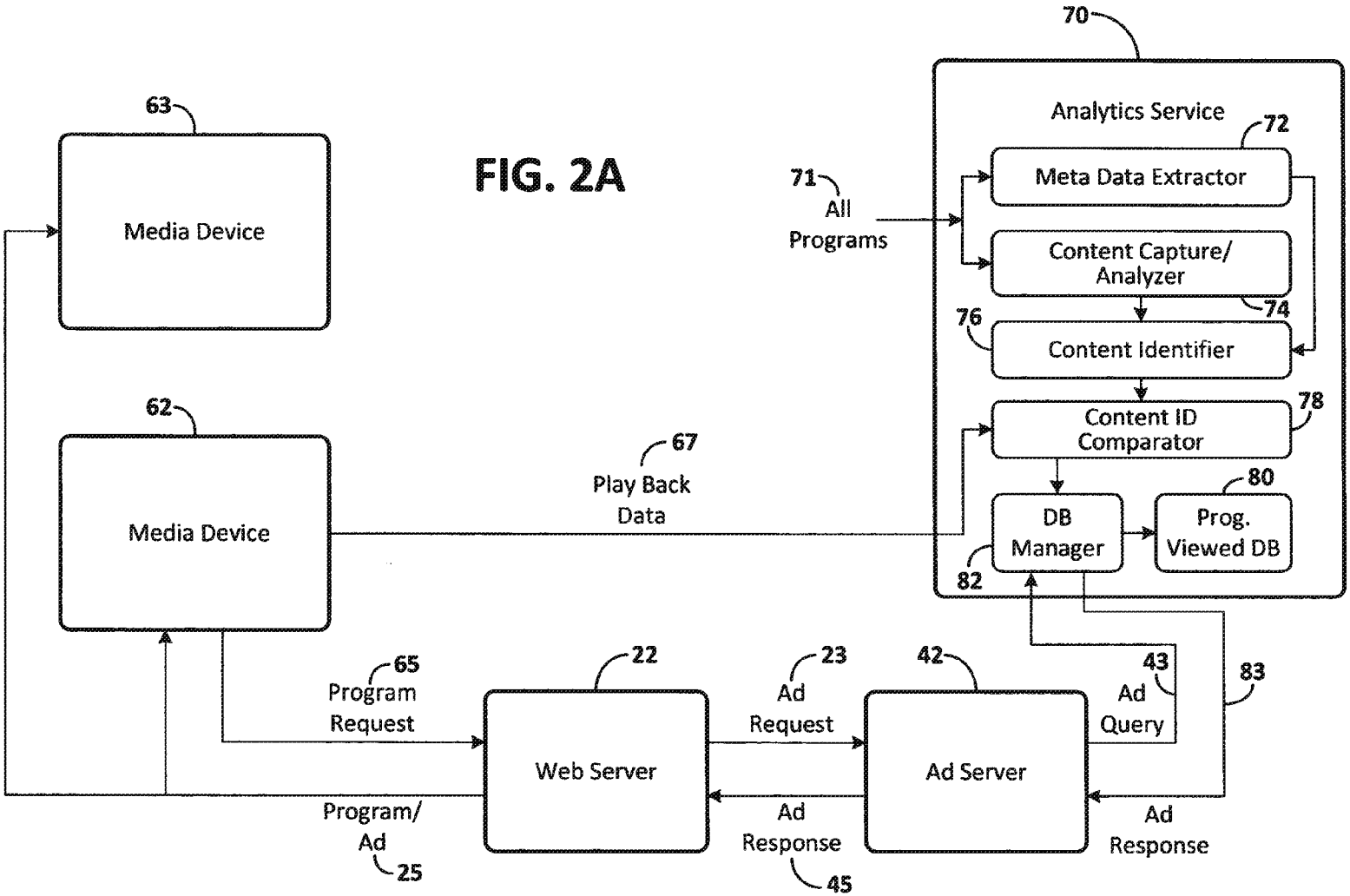
FIG. 2A illustrates examples of information passed among and processed by devices operating in the environment of FIG. 1.

FIG. 2A illustrates examples of information passed among and processed by devices operating in the environment of FIG. 1. In FIG. 2A, media device 62 provides playback data 67 to analytics service 70. The playback data 67 are described in detail with respect to FIG. 2B. The media device 62 also sends program request 65 to Web server 22. The program request 65 is used to download a streaming television program from the Web site 20. The media device 62 receives a program (e.g., streaming television program) and an advertisement 25 from the Web server 22. In an embodiment, the program/ad 25 may be sent to the media device 63. In this embodiment, the streaming television program may be displayed at the media device 62 and the advertisement displayed at the media device 63.

The Web server 22, in response to an access to the Web site 20 by the media device 62, may send an ad request 23 to the ad server 42 and in response receive ad response 45. The ad response 45 may indicate a category or type of ad to server, may indicate a specific ad to server, or may provide the ad creative (e.g., ad 44, see FIG. 1).

The ad server 42, in response to the ad request 23, may send ad query 43 to analytics service 70 and in response receive ad response 83. The ad response 83 may indicate a specific advertisement, advertisement category (e.g., for a domestic automobile), or advertisement type (e.g., a video ad) to serve at the Web site 20. The ad category 83 allows the ad server 42 to serve an advertisement that is appropriate based on accumulated advertisement viewing data.

The analytics service 70 includes metadata extractor 72, content capture/analyzer 74, content identifier 76, content ID comparator 78, advertisements viewed database 80, database manager 82, and inference engine 84. The extractor 72 extracts certain metadata from programs 71, and the analyzer 74 analyzes content of the programs 71. The programs 71 may include all television content; i.e., all programs and advertisements. In an embodiment, the analytics service 70 receives programs 71 that are broadcast or streamed, and that thus are capable of recording and delayed playback at the media device 62. The programs 71 include television programming and advertisements, for example. The metadata extractor 72 may extract an identification for an advertisement. The content capture/analyzer 74 may analyze the audio signals of a television program or an advertisement.

The content identifier 76 receives the advertisement ID from the metadata extractor 72 and audio signal from the analyzer 74 and uses these data to identify advertisements. The content ID comparator 78 receives the advertisement ID from the identifier 76 and compares the received advertisement ID an advertisement ID included in the playback data 67. When the comparison indicates a match, a reference to the advertisement is stored in advertisements viewed database 80 by the database manager 82. Thus, over time, the analytics service 70 may accumulate an advertisements viewed history for the viewer 66.

The inference engine 84 may use the accumulated advertisements viewed data to select future advertisements to be served at the Web site 20 and to be viewed at the viewer's media devices 62 and 63.

In an embodiment, the components and functions of the advertisement service 40 and the analytics service 70 are combined.

Figure 2B:
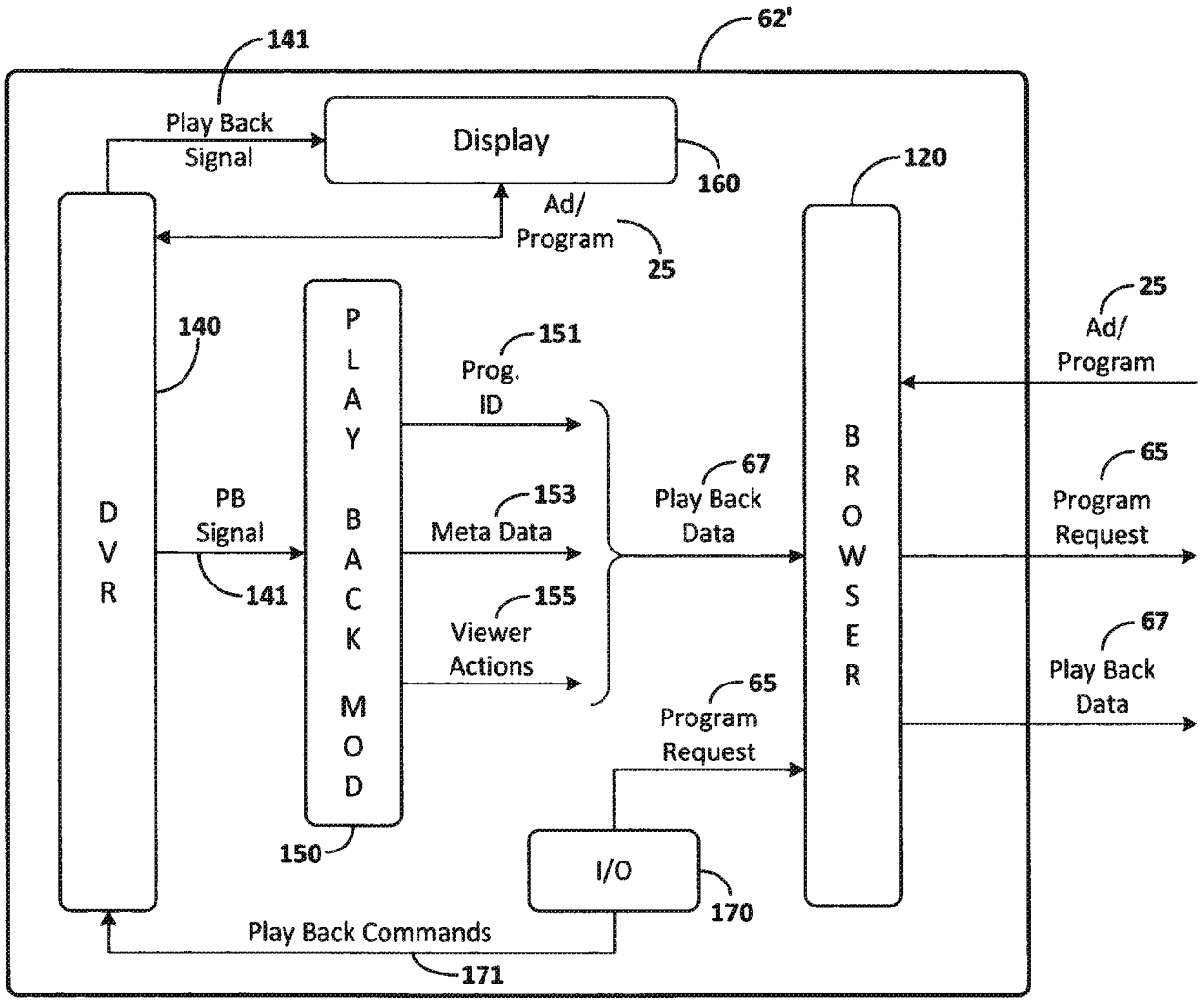
FIG. 2B illustrates an example of a device that records and provides time-shifted content viewing data.

FIG. 2B illustrates components 62' of the viewer's media device 62 that operate to collect advertisements viewed data, provide the collected data to the analytics service 70, and receive advertisements from the ad server 42. The components 62' include browser 120, digital video recorder 140, playback module 150, display 160, and input/output 170. The browser 120 accesses Web site 20 to receive streaming television programs, using program request 65. In response, the browser 120 receives the requested streaming television programs and one or more advertisements (e.g., ad/program 25). The browser 120 also provides playback data 67 to the analytics service 70. The browser 120 receives the playback data 67 from playback module 150. The playback data 67 includes a program/ad identification 151, other metadata 153, and viewer actions 155. The playback module 150 and the display 160 receive playback signal 141. The display 160 displays the streaming television program and advertisements. The playback module 150 extracts the program ID 151 and metadata 153 from the playback signal 141. The playback module 150 also extracts playback commands 171, such as skip, fast forward, rewind, and pause signals, provided by the viewer 66 using input/output 170.

Figure 3:
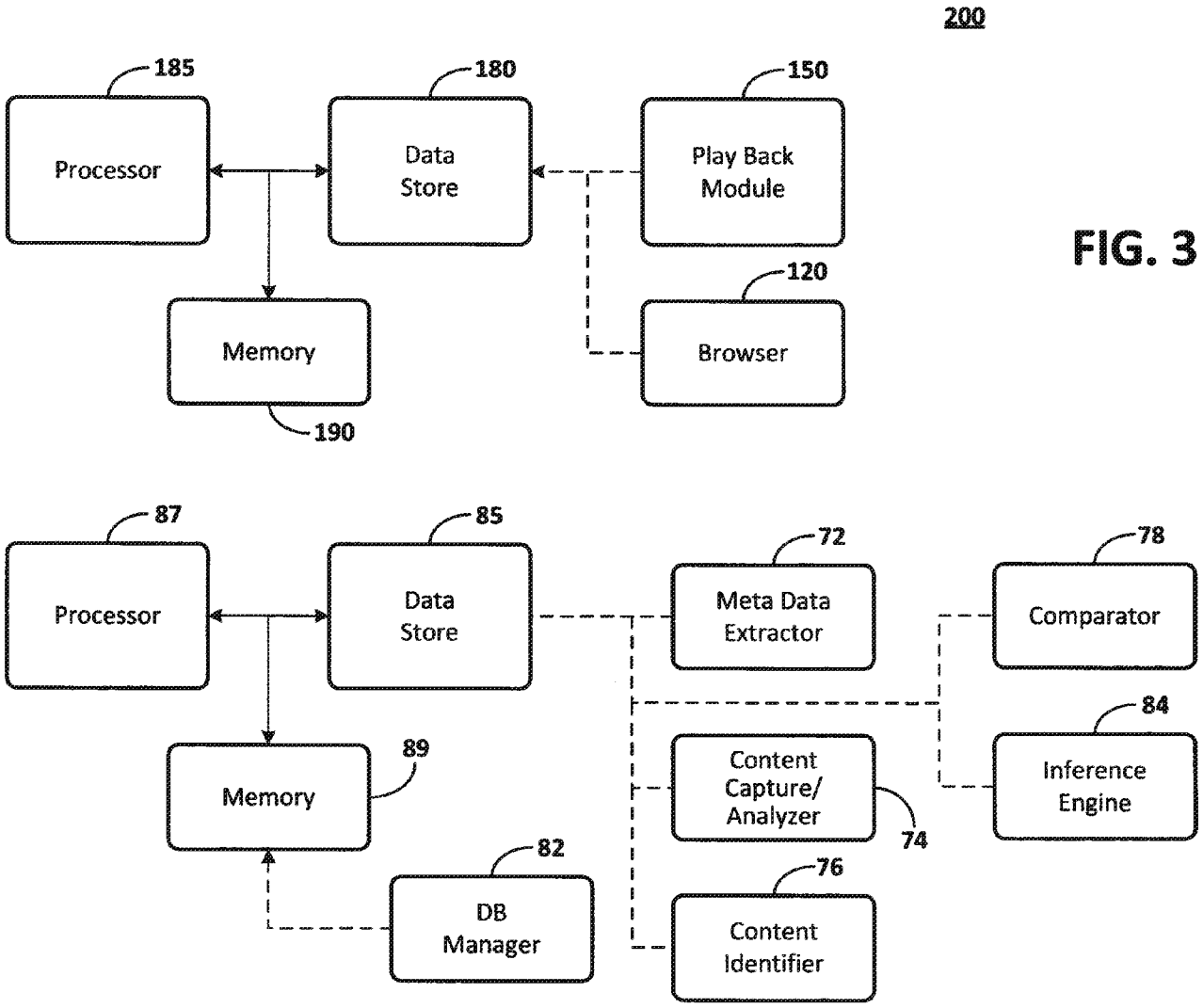
FIG. 3 illustrates an example content segment selection system based on time-shifted content viewing.

FIG. 3 illustrates an example content segment selection system based on time-shifted content viewing. In FIG. 3, content selection system 200 includes components at the media devices 62 and 63 and components at the analytics service 70. Media device 62, as an example, includes processor 185, data store 189, and memory 190. The processor 185 executes computer code stored in data store 180 after the code is read into memory 190. The computer code is stored in a non-transitory computer-readable storage medium. The computer code includes browser 120 and playback module 150, described above with respect to FIG. 2B.

The analytics service 70 includes processor 87, data store 85, memory 89, and software components including metadata extractor 72, content capture/analyzer 74, content identifier 76, comparator 78, and database manager 82, which are used to provide an advertisements viewed history for viewer 66, as described with respect to FIG. 2A. The analytics service 70 further includes inference engine 84. The components 72, 74, 76, 78, 82, and 84 may be stored in a non-transitory computer-readable storage medium of the data store 85.

The advertisements viewed history for a specific viewer 66 may include specific advertisement identifications, a number of time a specific advertisement was viewed, advertisement categories (e.g., automobiles, beer, cosmetics), brand names (e.g., all advertisements by manufacturer X), advertisements skipped or fast forwarded (allowing for a negative inference), time and date of advertisement viewing (i.e., certain advertisements are skipped or fast forwarded at certain times and dates, but are viewed at other times and date; all advertisements are skipped at certain times or dates, but some advertisements are viewed at other times and dates). The advertisements viewed history may be accumulated over weeks or months, for example. Alternately, only the most recent week or weeks of the advertisements viewed history may be retained in the data store 85 and used by the analytics service 70 to select or suggest an advertisement to serve to the viewer 66.

The inference engine 84 may be used to select a specific advertisement to be served at the Web site 20 when that Web site is visited by the viewer 66, or to select an advertisement category or advertisement type from which the ad server 42 may select an advertisement for serving. Alternately, the inference engine 84 may be used to select a specific advertisement, or an advertisement category and/or advertisement type to serve to when the viewer 66 executes an application 130 on the media device 62. The inference engine 84 may select an advertisement category (e.g., automobile) that has a highest history of being viewed, or may select the top three categories of advertisement categories. If multiple advertisement categories are suggested, the ad server 42 may select advertisements based on an auction scheme. If none of the previously served (i.e., time-shifted) advertisements shows a sufficiently high percentage of being viewed, the inference engine 84 may provide no suggestion to the ad server 42, and the ad server 42 may select advertisements to serve based on an auction scheme.

Figure 4:
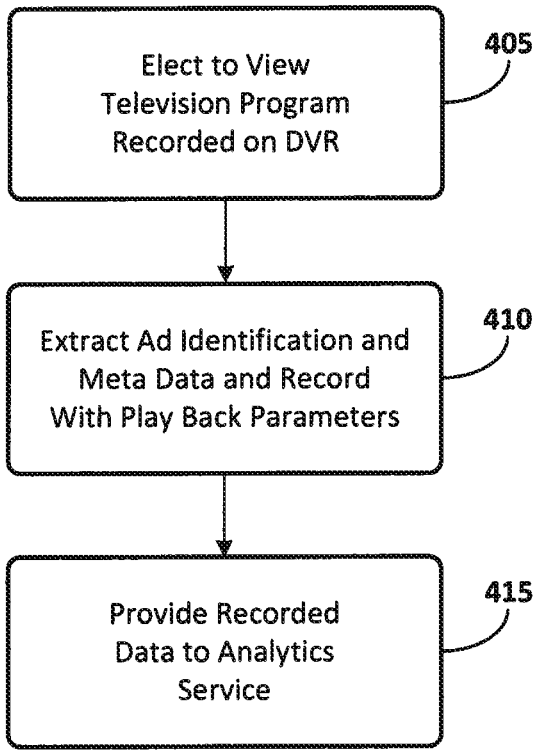
FIGS. 4-7 are flowcharts illustrating example processes for content segment selection based on time-shifted content viewing.

FIG. 4 is a flowchart illustrating an example process of the system 200 for content segment selection based on time-shifted content viewing. In FIG. 4, process 400 begins in block 405 when the viewer 66 elects to view a television program recorded on the DVR 140. The signal 141 comprising the recorded television program is passed through the playback module 150. In block 410, the playback module 150 extracts the identification for each advertisement viewed at normal speed (i.e., not skipped or fast forwarded). The playback module 150 also may extract other metadata related to the advertisement including the time and date of playback and the program in which the advertisement appears. Alternately, the playback module 150 detects and records the identification of all advertisements, whether played at normal speed or fast speed, or skipped, as well as other metadata, including the time and date of playback, fast forward, or skip and the program in which the advertisement appears. In this alternative, the playback module 150 also may record the playback speed. In block 415, the browser 120 provides the recorded playback data 67 to the analytics service 70. The process 400 then ends.

Figure 5:
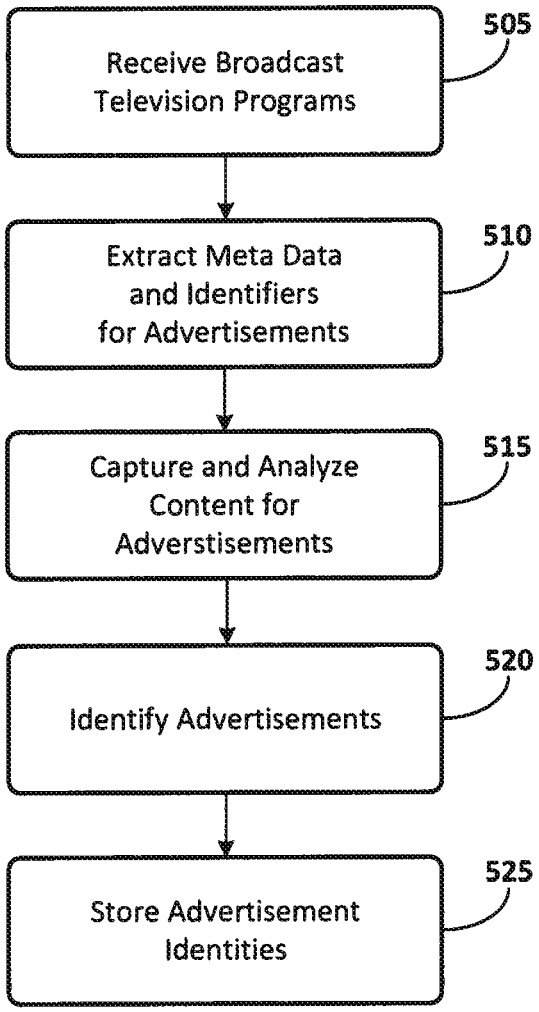

FIG. 5 is a flowchart illustrating another example process of the system 200 for content segment selection based on time-shifted content viewing. In FIG. 5, process 500 begins in block 505 when the analytics service 70 receives broadcast television programs 71. In block 510, the service 70 extracts metadata from the television programs 71, including an identifier for each advertisement, if available. In block 515, the service 70 uses content recognition techniques to capture and analyze content from each advertisement. In an embodiment, the service 70 uses audio content recognition techniques to determine the content of the advertisement. In block 520, the service 70 uses the advertisement ID and content data to identify the advertisement. In block 525, the service 70 stores the advertisement identification in data store 85. The process 500 then ends.

Figure 6:
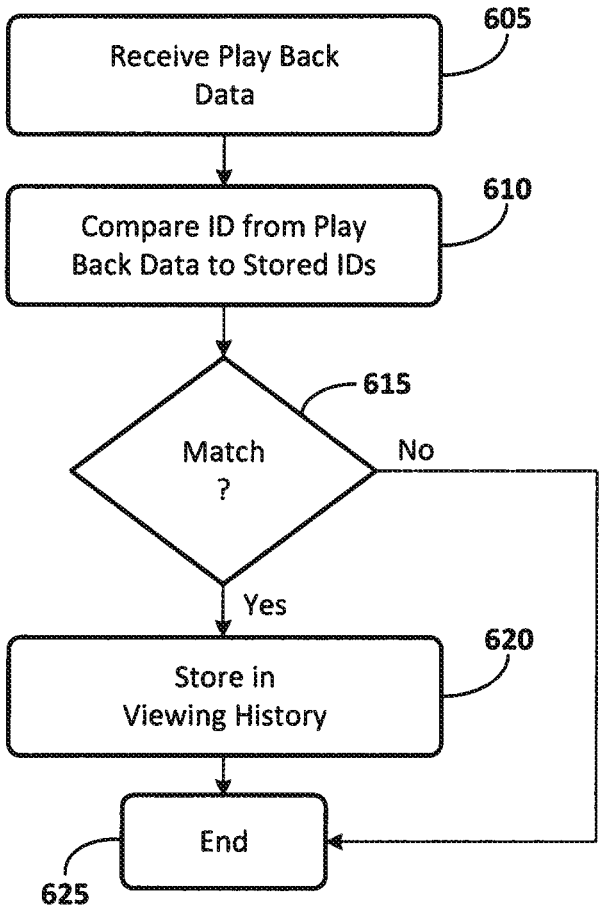

FIG. 6 is a flowchart illustrating another example process of the system 200 for content segment selection based on time-shifted content viewing. In FIG. 6, process 600 begins in block 605 when the service 70 receives playback data 67 from media device 62. The playback data 67 may be pushed to the service 70 periodically. Alternately, the service 70 may send a call to the media device 62 to report the collected playback data 67. In block 610, the service 70 compares the advertisement ID contained in the playback data 67 to advertisement IDs contained in the data store 85, and in block 615 determines if a match exists. If the service 70 cannot determine a match, the process moves to block 625 and ends. If the service 70 determines a match exists, the process 600 moves to block 620 and the database manager 82 stores the advertisement identification in an advertisements viewed database of the data store 85 for the viewer 66. The process 600 then moves to block 625 and ends.

Figure 7:
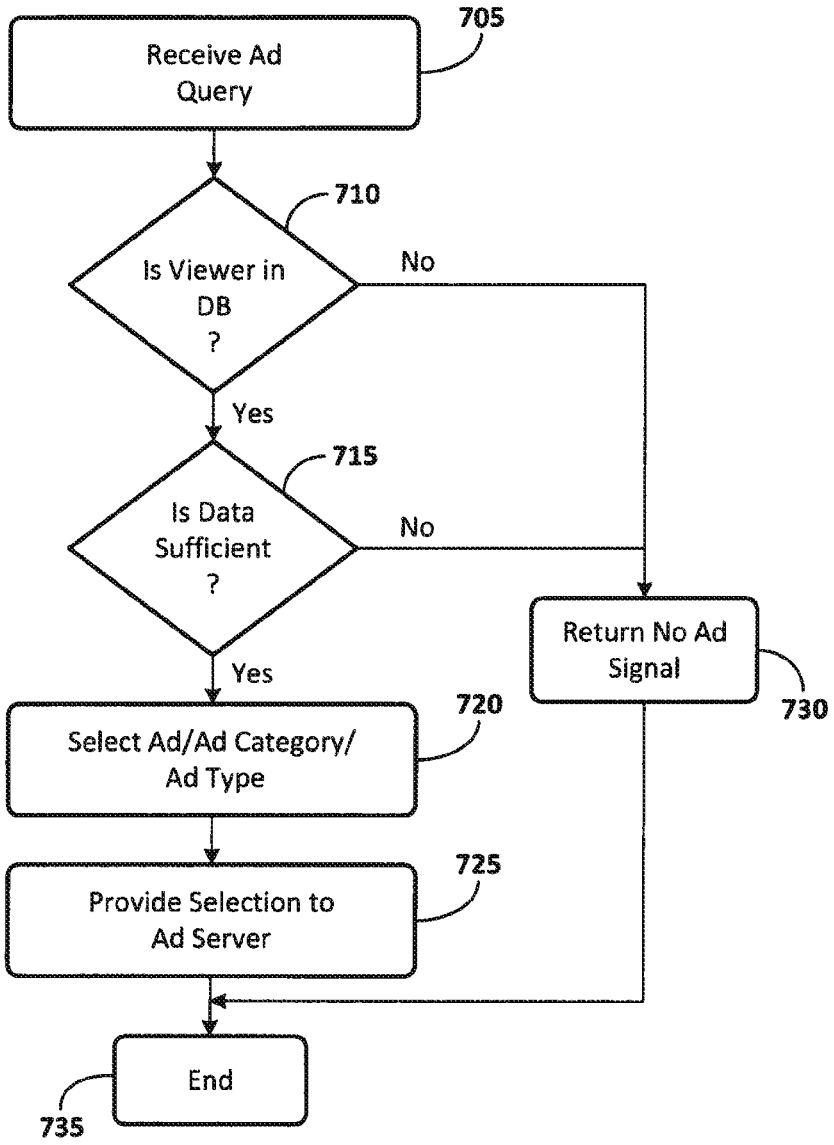

FIG. 7 is a flowchart illustrating yet another example process of the system 200 for content segment selection based on time-shifted content viewing. Process 700 begins in block 705 when the analytics service 70 receives an ad query 43 from the ad server 42 indicating that the viewer 66 is visiting the Web site 20 and requesting an advertisement to serve at the Web site 20. In an alternative, the ad server 42 may provide an ad query 42 for all accesses to the Web site 20. In block 710, the inference engine 84 determines if the viewer 66 is entered into the advertisements viewed history files of the data store 85. If the viewer 66 is not so entered, the process 700 moves to block 730. If the viewer 66 is entered, the process 700 moves to block 715 and the inference engine 84 determines if the viewer 66 has a sufficient accumulation of viewing. If the accumulation is not sufficient, the process 700 moves to block 730. In block 730, the inference engine 84 returns a "no ad" signal to the ad server 42. The process 700 then moves to block 735. If the accumulation is sufficient, the process 700 moves to block 720 and the inference engine 84 selects an advertisement category. In block 725, the inference engine 84 provides the selected advertisement category to the ad server 42. The process 700 then moves to block 735. In block 735, the process 700 ends.

Certain of the devices shown in FIGS. 1-3 include a computing system. The computing system includes a processor (CPU) and a system bus that couples various system components including a system memory such as read only memory (ROM) and random access memory (RAM), to the processor. Other system memory may be available for use as well. The computing system may include more than one processor or a group or cluster of computing system networked together to provide greater processing capability. The system bus may be any of several types of bus structures including a memory bus or memory controller, a peripheral bus, and a local bus using any of a variety of bus architectures. A basic input/output (BIOS) stored in the ROM or the like, may provide basic routines that help to transfer information between elements within the computing system, such as during start-up. The computing system further includes data stores, which maintain a database according to known database management systems. The data stores may be embodied in many forms, such as a hard disk drive, a magnetic disk drive, an optical disk drive, tape drive, or another type of computer readable media which can store data that are accessible by the processor, such as magnetic cassettes, flash memory cards, digital versatile disks, cartridges, random access memories (RAM) and, read only memory (ROM). The data stores may be connected to the system bus by a drive interface. The data stores provide nonvolatile storage of computer readable instructions, data structures, program modules and other data for the computing system.

To enable human (and in some instances, machine) user interaction, the computing system may include an input device, such as a microphone for speech and audio, a touch sensitive screen for gesture or graphical input, keyboard, mouse, motion input, and so forth. An output device can include one or more of a number of output mechanisms. In some instances, multimodal systems enable a user to provide multiple types of input to communicate with the computing system. A communications interface generally enables the computing device system to communicate with one or more other computing devices using various communication and network protocols.

The preceding disclosure refers to flowcharts and accompanying description to illustrate the embodiments represented in FIGS. 4-7. The disclosed devices, components, and systems contemplate using or implementing any suitable technique for performing the steps illustrated. Thus, FIGS. 4-7 are for illustration purposes only and the described or similar steps may be performed at any appropriate time, including concurrently, individually, or in combination. In addition, many of the steps in the flow chart may take place simultaneously and/or in different orders than as shown and described. Moreover, the disclosed systems may use processes and methods with additional, fewer, and/or different steps.

Embodiments disclosed herein can be implemented in digital electronic circuitry, or in computer software, firmware, or hardware, including the herein disclosed structures and their equivalents. Some embodiments can be implemented as one or more computer programs, i.e., one or more modules of computer program instructions, encoded on computer storage medium for execution by one or more processors. A computer storage medium can be, or can be included in, a computer-readable storage device, a computer-readable storage substrate, or a random or serial access memory. The computer storage medium can also be, or can be included in, one or more separate physical components or media such as multiple CDs, disks, or other storage devices. The computer readable storage medium does not include a transitory signal.

The herein disclosed methods can be implemented as operations performed by a processor on data stored on one or more computer-readable storage devices or received from other sources.

A computer program (also known as a program, module, engine, software, software application, script, or code) can be written in any form of programming language, including compiled or interpreted languages, declarative or procedural languages, and it can be deployed in any form, including as a stand-alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, subprograms, or portions of code). A computer program can be deployed to be executed on one computer or on multiple computers that are located at one site or distributed across multiple sites and interconnected by a communication network.

I claim:

1. A method, executed by a processor, for selecting content segments to serve to a viewer based on time-delayed television content viewed by the viewer, comprising:

receiving by the processor, a notification for a visit by the viewer to the resource;

accessing by the processor, a time-delayed content viewing history; and in response to the notification, identifying by the processor, based on the history, one or more content segments to serve at the resource, wherein the processor constructs the time-delayed content viewing history for the viewer, and wherein the processor:

receives broadcast television content, extracts a content segment identification for selected content segments, extracts metadata for each of the selected content segments, determines an identity of one or more of the selected content segments based on the extracted metadata, compares the identities of the selected content segments to corresponding identities provided by a device of the viewer to determine matches, and for a match, stores the identified content segment in the time-delayed content viewing history for the viewer.

2. The method of claim 1, wherein the content segments are advertisements.

3. The method of claim 2, wherein the content segments are identified by a specific content segment identification.

4. The method of claim 2, wherein the content segments are identified by a category of content segments.

5. The method of claim 2, wherein the content segments are identified by a type of content segment.

6. The method of claim 1, wherein the resource is a Web page.

7. The method of claim 6, wherein the Web page provides streaming television programs.

8. The method of claim 1, wherein the resource is an application installed on a media device operated by the viewer.

9. The method of claim 1, wherein the time-delayed content viewing history comprises:

identified content segments; and playback speed for each identified content segment.

10. The method of claim 1, wherein the time-delayed content viewing history comprises identified content segments played back at normal speed.

11. The method of claim 1, wherein the processor receives a broadcast signal from the device of the viewer, the broadcast signal including a content segment identification, content segment metadata, and viewer actions.

12. The method of claim 11, wherein the viewer actions comprise playback at normal speed, playback at fast speed, skip, pause, and rewind.

13. The method of claim 1, wherein the processor queries the device to provide the corresponding identities.

14. The method of claim 1, further comprising, sending, by the processor, a content segment response to a content segment server.

15. The method of claim 1, wherein the identifying one or more content segments to serve at the resource, comprises:

determining by the processor if a content viewing history exists for the viewer; and if a content viewing history for the viewer exists, determining by the processor if the history for the viewer includes a sufficient number of entries.

16. A computer-readable storage medium having encoded thereon computer code executable by a processor, wherein the processor executes the computer code to:

receive a notification for a visit by the viewer to the resource;

access a time-delayed content viewing history; and in response to the notification, identify, based on the history, one or more content segments to serve at the resource, wherein the time-delayed content viewing history comprises identified content segments, and playback speed for each identified content segment, wherein the time-delayed content viewing history comprises identified content segments played back at normal speed, and wherein the processor:

receives broadcast television content;

extracts a content segment identification for selected content segments;

extracts metadata for each of the selected content segments;

determines an identity of one or more of the selected content segments based on the extracted metadata;

compares the identities of the selected content segments to corresponding identities provided by a device of the viewer to identify matches; and for a match, stores the identified content segment in the time-delayed content viewing history for the viewer.

* * * * *